US005114469A

United States Patent [19]

Weiman

[11] Patent Number: 5,114,469

[45] Date of Patent: May 19, 1992

[54] LOW-TEMPERATURE CONSOLIDATION METAL-BASED COMPOSITIONS AND METHOD

[75] Inventor: Sam M. Weiman, Cypress, Calif.

[73] Assignee: General Dynamics Corporation Air Defense Systems Division, Pomona, Calif.

[21] Appl. No.: 131,497

[22] Filed: Dec. 10, 1987

[51] Int. Cl.[5] ..... C20L 29/12

[52] U.S. Cl. ..... 75/235; 75/232; 75/236; 75/244; 419/13; 419/17; 419/19; 419/20; 419/47; 419/53; 419/54; 419/55

[58] Field of Search ..... 75/232, 235, 236, 244; 419/13, 17, 19, 20, 47, 53, 54, 55

[56] References Cited

U.S. PATENT DOCUMENTS

| | | | |
|---|---|---|---|
| 3,964,878 | 6/1976 | Scheithauer et al. | 419/17 |
| 4,587,095 | 5/1986 | Yoshimura et al. | 419/14 |
| 4,599,214 | 7/1986 | Luton | 419/19 |

*Primary Examiner*—Stephen J. Lechert, Jr.

[57] ABSTRACT

A process for producing high-strength, substantially nonporous alloys by means of a three-component mixture, including admixing a first component of one or more low-melting temperature metals or alloys thereof, a second component of one or more high-melting temperature metals or alloys thereof, and a substantially inert third component of one or more refractory compounds, subjecting the mixture to changes in temperature so as to form a mixture capable of being shaped at a temperature well below the melting or decomposition temperature of the highest melting metal and the inert refractory compound.

16 Claims, No Drawings

LOW-TEMPERATURE CONSOLIDATION METAL-BASED COMPOSITIONS AND METHOD

BACKGROUND OF THE INVENTION

Despite advances in metallurgy in the past decade, there is still not a facile technique for producing nonporous, high-strength metal alloys at low temperatures. A widely used method consists of mixing two metals with different melting temperatures and raising the temperature to just above that of the lowest melting metal. This method has the advantage of forming alloys at relatively low temperatures and, moreover, enables them to be shaped into a desirable configuration at low temperatures and low pressures. The method is particularly advantageous in instances where a reactive metal with a high melting temperature is sought to be alloyed to a relatively low-melting and less reactive metal. Nevertheless, however, the alloys produced by this technique are not strong enough for a wide number of applications calling for high-strength alloys.

Other methods for producing metal alloys also generally do not readily yield nonporous high-strength products at low temperatures. For instance, the processes described in U.S. Pat. No. 2,581,252, No. 2,714,556, and No. 4,432,935 all yield porous metal alloys. Several other methods involve an impregnation process that comprises introducing into a porous structure one or more metals and heating the object to form a structural alloy. A representative example of this process is U.S. Pat. No. 4,155,755.

It is apparent that it is desirable to have a process for producing nonporous metal alloys of high strength that can be generated at low temperatures.

SUMMARY OF THE INVENTION

A process is described for producing three-component metallurgy products that involves a first component of one or more low-melting temperature metals or alloys thereof, a second component of one or more high-melting temperature metals or alloys thereof, and a third component of one or more refractory compounds. All components are admixed in a state of subdivision such that the second component is preferably coarser than the first component, which in turn is preferably coarser than the third component. The mixture is heated to a temperature in the proximity of the melting point of the lower melting metal until it forms a semi-solid mass. Subsequently, the temperature is lowered to below the melting temperature of the first component, and the mixture is shaped into a desirable configuration with low porosity while at this temperature. The first component having a lower melting temperature than the second component and in a state of finer subdivision than the second component, will in time, diffuse substantially completely into the higher melting second component. To ensure complete diffusion of the first component into the second component, the mixture is heated to a temperature above the melting point of the first component but below the melting or decomposition temperatures of the second and third components.

DETAILED DESCRIPTION OF THE INVENTION

The invention described herein allows for the formation of a three-component alloy composed of one or more low-melting temperature metals or alloys thereof, a second component of one or more high-melting temperature metals or alloys thereof, and a third component of one or more refractory compounds. For the remainder of this discussion, reference to metal alloys in the three-component system in lieu of their corresponding elemental metals will be omitted as the application of the invention to metal alloys is understood by those skilled in the art to come within its scope.

The first and second component metals with different melting temperatures, and a refractory third compound, are blended or otherwise treated to form a fine powered mixture, and then placed in a suitable container such as a mold or die. The first metal component has a low melting temperature relative to the second metal component, with both metals having melting temperatures generally in the range of 250° C. - 650° C. and 1000° C. - 2000° C., respectively. The third refractory component has a melting temperature close to, or greater than, that of the highest melting metal sought to be alloyed. Examples of second component high-melting metals are nickel, titanium, zirconium, cobalt, iron, copper, niobium, molybdenum, tantalum, tungsten and their alloys. Examples of refractory components are SiC, $Si_3N_4$, $B_4C$, $Al_2O_3$, $Y_2O_3$, $SiO_2$, MgO, $Cr_2O_3$, and the like. Examples of low-melting metals are aluminum, magnesium, zinc, tin, lead, and their alloys, respectively.

The three components are mixed in a projected volume-percent capable of yielding a malleable or moldable alloy that exhibits high tensile strength. The fully reacted composite strength attainable is a function of relative quantities, nature and powder size relationships of the components. Thus, while the amounts of the three components may vary substantially, generally, the lowest melting metal and the refractory compound will compose, at a minimum, 5% and 10-60%, respectively. The highest-melting metal will make up the difference in the projected volume-percent.

The mixture is subject to a liquid sinter process by raising the temperature to or slightly above the melting temperature of the first component metal and held there until the powered mixture becomes semi-solid. Depending on the percentages and/or the nature of the metals used to form the alloy, it may be desirable to increase the efficiency of sintering of the three components by subjecting the mixture to a slight increase in pressure. This can be achieved by methods well-known in the art—particularly, hydraulic presses and the like are suitably employed. At this point, the temperature of the mixture should be lowered to below the melting temperature of the first component metal if the mixture is desired to be worked into a configuration by forging, rolling, extruding, or by other means suitable for shaping the alloy. By lowering the temperature below that of the melting point of the first component metal, the mixture assumes a pasty consistency, which enables one to impart thereto any desired shape. Thus, the pasty mixture can be worked into molds with intricate cavities and the like and, hence, assume configurations reflective of intricately designed molds. Following the liquid sintering and molding steps, the temperature of the mixture is increased to effect a diffusion step to ensure that the lowest melting metal component has reacted or diffused into the highest melting metal component. This step is particularly desirable to produce high-strength alloys. The change in temperature and the duration to which the mixture is exposed is not invariant and depends on the types of metals used as well as the degree of strength sought to be achieved in the final alloy product, as well as maintaining sufficient strength at the diffusion temperature to avoid distorting the pre-achieved intricate shape. In all instances, however, the temperature will be less than the melting and decomposition temperatures of the highest melting metal component and the refractory third compound. Generally, the metals will be held at the elevated temperature for between 1 to 48 hours dependent upon the time, temperature and the diffusion characteristics of the two metals involved.

In lieu of performing the diffusion step while the mixture is situated in a mold, die, etc., it can equally well be carried out if the mixture is separate from the mold, especially if the mold material tends to react with the mixture component(s) at the diffusion time and temperature conditions. In most instances, the consistency of the mixture will enable it to retain its shape when it is free of support provided by the mold. Additionally, it should be noted that this step does not have to be conducted within a predefined period of time after the initial molding event. It can be effected at virtually any time after the mixture is molded.

The following examples are given to aid in understanding the invention, but it is to be understood that the invention is not limited to the particular materials or procedures of the examples.

EXAMPLE I

To form an alloy of titanium, aluminum, and SiC, the three components are finely powdered, placed in a mold, and then heated to just above the melting point of the aluminum. About 50% by volume of titanium, 10% by volume of aluminum, and 25% by volume of SiC are reduced to a semi-solid mass at a temperature of about 700° C. Next, the temperature is lowered to below 660° C., whereupon the material assumes a paste-like consistency that can be shaped by forging, rolling, extruding procedures, hydraulic die pressure or the like. Next, to ensure that the mixtures forms a uniform alloy, the green shape is heated to 700° C. to 850° C. for 24 hours; starting at the lower temperature and slowly increasing the temperature about 10° C. per hour until the higher temperature is reached.

EXAMPLE II

An alloy of copper, tin, and $Al_2O_3$ is prepared by mixing 5% by volume of tin, 20% by volume of $Al_2O_3$, and copper in a suitable mold and heating the mixture until a semi-solid mass forms. The temperature is then lowered to below the melting temperature of tin whereupon the material is molded into a desirable configuration. Lastly, the temperature is slowly increased from 250° C. to 750° C. over a period of 48 hours to ensure uniformity of the agglomerate.

EXAMPLE III

Copper, aluminum, and Si3N4 alloys can be constructed by admixing powdered amounts of the three in a mold, including 10% by volume aluminum, 20% by volume $Si_3N_4$, and copper. The mixture is heated until the powder assumes a paste-like consistency. Next, the temperature is reduced, and the paste shaped by rolling, forging, extruding, etc. The mixture is next subjected to a starting temperature of 700° C. increasing to 900° C. over a period of 24 hours to produce an alloy with uniform consistency.

EXAMPLE IV

An agglomerate of cobalt with zinc and $B_4C$ is constructed by mixing the three in a mold and heating the mixture to until it exhibits a pasty consistency. The mixture consists of 25% zinc, 20% $B_4C$, and the remainder cobalt. This liquid sinter solidification process is followed by cooling the mixture, which gives it a moldable pasty consistency. The agglomerate is then molded into the desirable shape and homogenized. The latter is accomplished by raising the temperature from 450° C. to 950° C. over a time period of 24 hours.

EXAMPLE V

An alloy of titanium, tin (7% by volume), and $Y_2O_3$ (20% by volume) is formed by combining fine powders of each into into a mold, heating the mixture until it displays a semisolid mass, upon which the powder assumes the consistency of a paste. Next, the temperature is lowered, and the material is shaped as desired and then is heated by raising the temperature from 250° C. to 750° C. over 24 hours.

We claim:

1. A process of making substantially nonporous three-component metal articles comprising:

forming a mixture of a first component of one or more low-melting temperature metals or alloys thereof, a second component of one or more high-melting temperature metals or alloys thereof, a third component of one or more refractory compounds, in a fine state of subdivision, said first and second components or alloys thereof having low and high melting temperatures, respectively, and said refractory component having a melting temperature about or greater than said melting temperature of said second component or alloys thereof;

heating said mixture until a semi-solid mass forms, and subsequently lowering the temperature below the melting temperature of said first component or alloy thereof, and shaping said mixture while at said temperature; and raising the temperature above the melting temperature of said first component or alloy thereof and below the melting temperature of said second component or alloy thereof and said refractory third component until said mixture exhibits uniform consistency.

2. The process as described in claim 1 wherein said refractory component is selected from the group consisting of SiC, $Si_3N_4$, $B_4C$, $Al_2O_3$, $Y_2O_3$, $SiO_2$, MgO, and $Cr_2O_3$.

3. The process as described in claim 2 wherein said refractory component occupies a minimum volume-percent of 10%-60% of said mixture.

4. The process as described in claim 1 wherein said second component is selected from the group consisting of nickel, titanium, zirconium, cobalt, iron, copper, niobium, molybdenum, tantalum, tungsten, and alloys thereof.

5. The process as described in claim 1 wherein said first component is selected from the group consisting of aluminum, magnesium, zinc, tin, or lead.

6. The process as described in claim 5 wherein said first component occupies a minimum volume-percent of 5% of said mixture.

7. Metal alloys produced by a process comprising:

forming a mixture of a first component of one or more low-melting temperature metals or alloys thereof, a second component of one or more high-melting temperature metals or alloys thereof, a third component of one or more refractory compounds, in a fine state of subdivision, said first and second components or alloys thereof having low and high melting temperatures, respectively, and said refractory component having a melting temperature about or greater than said melting temperature of said second component or alloys thereof;

heating said mixture until a semi-solid mass forms, and subsequently lowering the temperature below the melting temperature of said first component or alloy thereof, and shaping said mixture while at said temperature; and raising the temperature above the melting temperature of said first component or alloy thereof and below the melting temperature of said second component or alloy thereof and said refractory third component until said mixture exhibits uniform consistency.

8. Metal alloys produced as described in claim 7 wherein said refractory component is selected from the group consisting of SiC, $Si_3N_4$, $B_4C$, $Al_2O_3$, $Y_2O_3$, $SiO_2$, MgO, and $Cr_2O_3$.

9. Metal alloys produced as described in claim 8 wherein said refractory component occupies a minimum volume-percent of 10%-60% of said mixture.

10. Metal alloys produced as described in claim 7 wherein said second component is selected from the group consisting of nickel, titanium, zirconium, cobalt, iron, copper, chromium, niobium, molybdenum, tantalum, tungsten and their alloys.

11. Metal alloys produced as described in claim 7 wherein said first component is selected from the group consisting of aluminum, magnesium, zinc, tin, or lead.

12. Metal alloys produced as described in claim 11 wherein said first component occupies a minimum volume-percent of 5% of said mixture.

13. A process for forming substantially nonporous three-component metal alloy articles comprising:

admixing said three components in a container suitable for shaping said article to form a mixture a first component being 10%-25% by volume of aluminum , second component being 25% by volume of SiC, and a third component being 50% by volume titanium in a fine state of subdivision, and heating said mixture until a semi-solid mass forms, and lowering said temperature to below the melting point of said first component until said mixture exhibits a paste-like consistency, shaping said mixture, and anytime thereafter heating said mixture to a temperature below the melting point of said second and third components for between 1 to 48 hours.

14. Substantially nonporous three-component metal alloy articles produced comprising the steps of:

admixing said three components in a container suitable for shaping said article to form a mixture wherein said first component is 25% by volume aluminum, said second component is 20% by volume titanium, and said third component is lead in a fine state of subdivision, and heating said mixture until a semi-solid mass forms, and lowering said temperature to below the melting point of said first component until said mixture exhibits a paste-like consistency, and anytime thereafter heating said mixture to a temperature below the melting point of said second and third components for between 1 and 48 hours.

15. A process for forming substantially nonporous three-component articles comprising:

admixing said three components in a container suitable for shaping said article to form a mixture wherein said first component is 5% by volume tin, said second component is 75% by volume copper, and said third component is 20% by volume aluminum oxide in a fine state of subdivision, and heating said mixture until a semi-solid means forms, and lowering said temperature to below the melting point of said first component until said mixture exhibits a paste-like consistency, and anytime thereafter heating said mixture to a temperature below the melting point of said second and third components for between 1 and 48 hours.

16. Substantially nonporous three-component metal alloy articles produced comprising the steps of:

admixing said three components in a container suitable for shaping said article to form a mixture wherein said first component is 10% by volume aluminum, said second component is 70% by volume copper, and third component is 20% by volume $Si_3N_4$ in a fine state of subdivision, heating said mixture until a semi-solid mass forms, and lowering said temperature to below the melting point of said first component until said mixture exhibits a paste-like consistency, and anytime thereafter heating said mixture to a temperature below the melting point of said second and third components for between 1 and 48 hours.

* * * * *